US006520371B2

(12) United States Patent
Cheng

(10) Patent No.: US 6,520,371 B2
(45) Date of Patent: Feb. 18, 2003

(54) TISSUE BOX SUPPLEMENTAL ADAPTER

(76) Inventor: Mark Cheng, 888 Brannan St., Show-Room #1100, San Francisco, CA (US) 94103

( * ) Notice: Subject to any disclaimer, the term of this patent is extended or adjusted under 35 U.S.C. 154(b) by 0 days.

(21) Appl. No.: 09/823,687

(22) Filed: Mar. 29, 2001

(65) Prior Publication Data

US 2002/0175176 A1 Nov. 28, 2002

(51) Int. Cl.[7] ..... B65H 1/00
(52) U.S. Cl. ..... 221/33; 221/45; 221/63
(58) Field of Search ..... 221/33, 45, 46, 221/47, 48, 63; 206/233

(56) References Cited

U.S. PATENT DOCUMENTS 3,207,360 A * 9/1965 Scott
3,266,666 A * 8/1966 Nelson
3,343,716 A * 9/1967 Peebles
3,349,959 A * 10/1967 Watkins
3,994,417 A * 11/1976 Boedecker ..... 221/63
4,411,374 A * 10/1983 Hotchkiss ..... 221/63
5,054,612 A * 10/1991 Meyer, Jr. ..... 206/233
5,509,571 A * 4/1996 Weber ..... 221/46

* cited by examiner

*Primary Examiner*—David H. Bollinger
(74) *Attorney, Agent, or Firm*—Intellectual Property Law Group LLP; Otto O. Lee; Juneko C. Jackson

(57) ABSTRACT

A tissue box supplemental adapter is disclosed in which a narrow slit, or any narrow or small opening in any form or shape that serves the purpose of holding tissues in place, is cut in the center of the adapter, which will be placed on top of a tissue box, to keep the tissues constantly in a withdrawn position outward.

9 Claims, 3 Drawing Sheets

TISSUE BOX SUPPLEMENTAL ADAPTER

BACKGROUND

This invention relates generally to a box adapter, and specifically relates to a tissue box supplemental adapter in which a central opening in a shape of a substantially rectangular narrow slit, or any other narrow or small opening in any form or shape that serves the purpose of holding a sheet of tissue to remain partially withdrawn from a tissue box, is cut in the center of the adapter, which will be placed on top of a box of tissues. Further, this invention may be used in lieu of the tissue box and function as a tissue box on its own.

The opening of conventional tissue box, which is often made of a plastic film, is cut quite large in length, to allow tissues to be pulled up through the top easily. While this is acceptable in the beginning when tissues are still able to be held up firmly one after another, over time, the plastic film becomes enlarged with wear and tear and causes the tissues to eventually drop back into an often half-empty box. The user will have to reach into the box to retrieve a tissue, which will cause further breakage of the plastic film. The tissues at this point are no longer held firmly in place by the plastic film.

In addition, tissues are intended to be dispensed one tissue after another, but after the plastic film in a conventional tissue box becomes worn out over time, the user ends up pulling more than one tissue at a time. The wear and tear to the plastic film most frequently occurs during nighttime when users try to reach for tissues in the dark. Such wear and tear of the plastic film leads to waste of tissues, as oftentimes the users who remove more than one sheet of tissue at a time do not replace the excessive tissue back into the box, and rather, use the entire sheets.

Moreover, after tissues drop back into the box because of the wear to the plastic film, users will need to grab tissues by touching the edges of the plastic film and digging around in the conventional tissue box to pull a tissue back up again. This constant handling of the clean tissues in the box and touching of the plastic film undeniably leads to contamination of the tissues.

Efforts have been made to prevent tissues pulled out from the tissue box from sinking inside the tissue box by using a cover case for the tissue box. In one conventional cover case, a tissue box is housed within a case main body, whereby an opening for allowing tissues to be drawn out from the tissue box is located on the upper surface of the case main body, and a cover is connected to the case main body by way of a hinge to the case main body. On an inner surface of the cover, a holding member is provided to position the tissue drawn out from the opening along the inner surface. However, this conventional cover case does not address the problem of multiple sheets of tissue being pulled out from the box at a time, nor does it remedy the problem of maintaining the tissues to remain withdrawn, one sheet at a time, for easy access by the user.

SUMMARY

Accordingly, this device is designed to help eliminate these problems. The present invention meets these needs by providing a new and useful tissue box supplemental adapter, in which a narrow slit or any small opening is cut in the center of the adapter that is to be placed on top of a tissue box. The slit or opening can be in any form or shape that serves the purpose of holding the tissues in place, to keep the pull of tissues out constantly.

The present adapter also ensures that tissues remain withdrawn all the time above the slit opening, resulting in enhanced convenience for the user, since the user no longer has to reach deep into the tissue box to retrieve the tissues.

The present adapter also promotes good hygiene. The user, who is often the carrier of germs due to sickness or otherwise, would not accidentally grab more than one sheet of tissue at a time, the excess of which would often be replaced back into the tissue box. Thus, every sheet of tissue coming out from the tissue box employing the present adapter would be free of contamination by germs which may be spread by the user. The tissue box itself and its opening would be free of contamination, as well, since the user no longer has to reach into the box to retrieve the tissues.

Therefore the present invention satisfies the long felt need of having a tissue box supplemental adapter that is able to keep the pull of tissues out constantly, and to allow users to conveniently retrieve the tissues from the tissue box, one at a time.

DRAWINGS

These and other features, aspects, and advantages of the present invention will become better understood with regard to the following description, appended claims, and accompanying drawings where:

DETAILED DESCRIPTION OF THE INVENTION

The following discussion describes in detail one embodiment of the invention and several variations of that embodiment. This discussion should not be construed, however, as limiting the invention to those particular embodiments. Practitioners skilled in the art will recognize numerous other embodiments as well. For a definition of the complete scope of the invention, the reader is directed to the appended claims.

Figure 11:
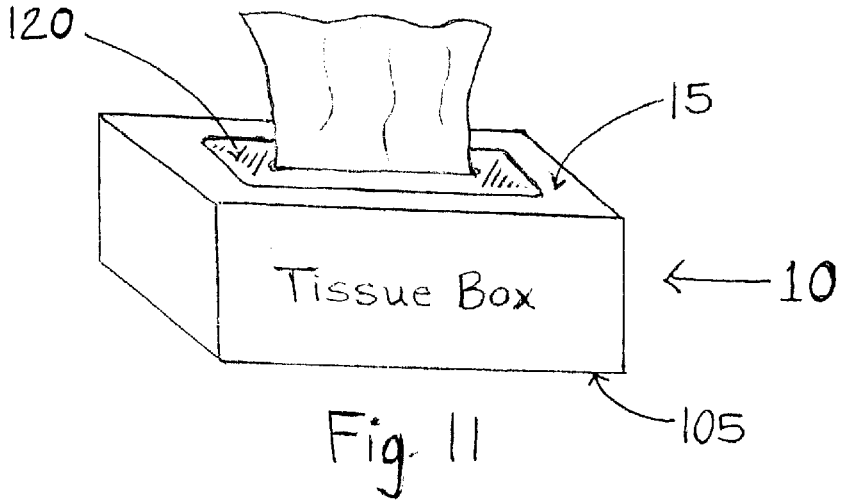
FIG. 11 illustrates a conventional tissue box having a plastic film.

The invention is a tissue box supplemental adapter 20 in which a central opening 30 in a shape of a substantially rectangular narrow slit, or any other narrow or small opening in any form or shape that serves the purpose of holding tissues in place, is cut in the center of a flat main body 25 of the adapter, which will be placed on a top surface 15 of a conventional tissue box 10 as in FIG. 11. Note, however, that the conventional tissue box 10 as illustrated in FIG. 11 is only one example of conventional tissue boxes, and the figure is not in any way drawn to exact scaled dimension or shape. The present invention may work with other types of tissue box, including but not limited to, a tissue box with a cubic shape.

Tissues generally measure 9 inches by 8 inches in rectangular boxes, while they measure 8 inches by 8 inches in square tissue boxes.

To make sure tissues will remain withdrawn at all times with the supplemental adapter, the size and design of the central opening 30 in the adapter have been carefully calculated and tested.

Figure 6:
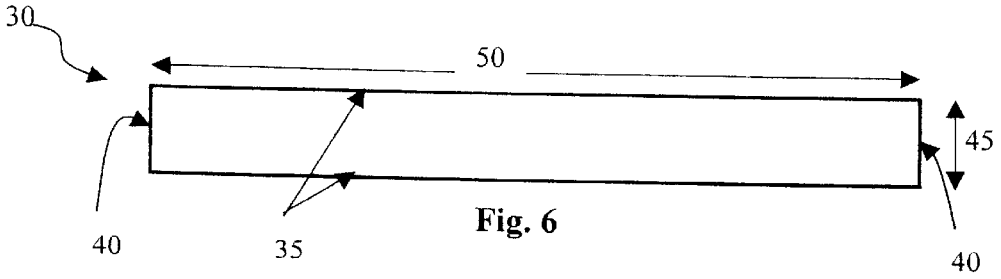
FIG. 6 illustrates a substantially rectangular central opening of one embodiment of the present invention, having a predetermined width and length.

In a preferred embodiment, the central opening 30 has a pair of opposing long sides 35 and a pair of opposing short sides 40 as in FIG. 6. The calculated dimensions are as follows: the length 50 of the opposing long sides 35 would be less than half of the length of tissues, as this would squeeze tissues gently without excessive force. Thus, the length 50 of the opposing long sides 35 would be between two and five inches, inclusive. At the same time, the width 45 of the opposing short sides 40 would be between a quarter and three-quarters of an inch, inclusive, and roughly about half an inch. Such dimensions serve to hold the tissues in a withdrawn position.

Figure 9:
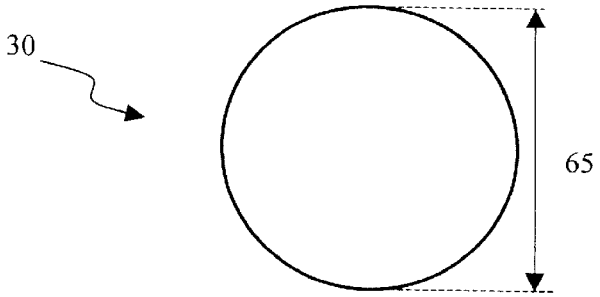
FIG. 9 illustrates a central opening of one embodiment of the present invention having a substantially round shape.
Figure 10:
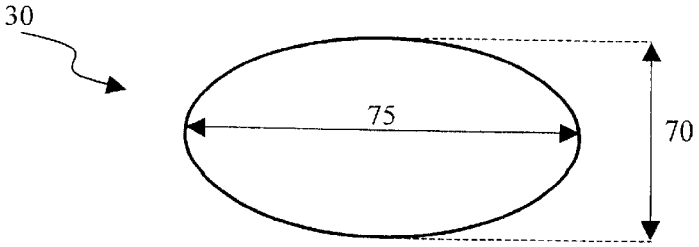
FIG. 10 illustrates a central opening of one embodiment of the present invention having a substantially oval shape.

For shapes of central openings 30 other than substantially rectangular shape, the calculated dimensions are as follows: for round shapes or similar shapes as in FIG. 9, the diameter 65 of the opening is between one half to one-and-a-half inch, inclusive; for oval shapes as in FIG. 10, the dimension is less than or equal to one-and-a-half inch in minor axis length 70 and less than or equal to two inches in major axis length 75; for other shapes, the dimension is less than or equal to one-and-a-half inch in width 45 by less than or equal to two inches in length 50.

The experimentation necessary to determine the above dimensions included pulling tissues from a fully loaded tissue box, a half empty tissue box, and a nearly empty tissue box, until the last tissue was removed from the boxes. The tests resulted in 99.8% effectiveness for the present invention in maintaining the constantly upward or withdrawn position of the tissues as they protrude from the tissue box.

In a preferred embodiment, the central opening 30 having a substantially rectangular shape has the dimensions as follows:

| Shape of Tissue Box | Length 50 | Width 45 |
|---|---|---|
| Rectangular Surface | 3½ to 4 inches | ⅜ to ½ inches |
| Square Surface | 3 to 3½ inches | ⅜ to ½ inches |

Figure 7:
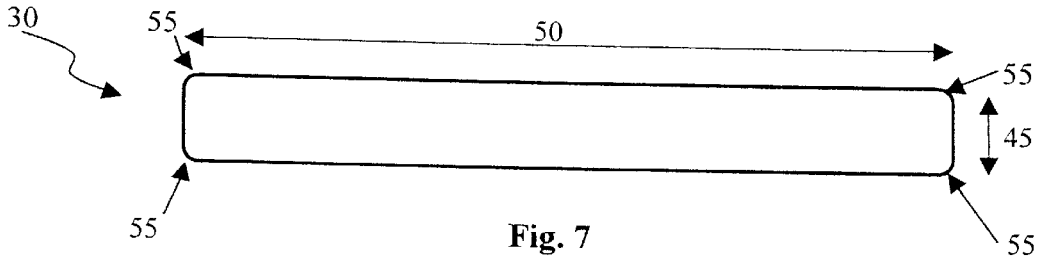
FIG. 7 illustrates the substantially rectangular central opening of FIG. 6, further having arched and smoothed edges.
Figure 8:
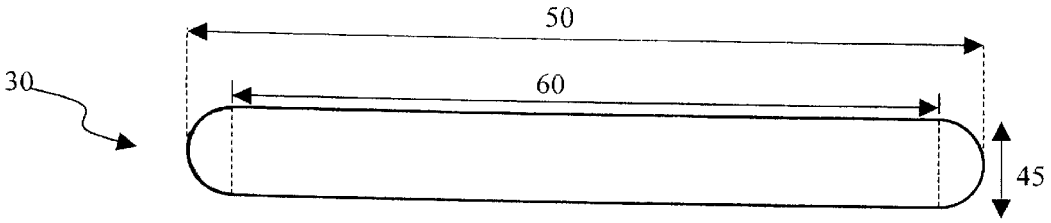
FIG. 8 illustrates the substantially rectangular central opening of FIG. 6, further having a pair of opposing short sides which are semi circular in shape.

In another preferred embodiment, a round-ended central opening as in FIG. 7 or FIG. 8 is preferred compared to other shapes because such opening would not cause the tissues to be torn when pulled. The slit in FIG. 7 shows corners 55 which are arched and smooth in shape, so as not to form any sharp edges. The round-ended central opening in FIG. 8 has a pair of opposing short sides 40 which are semi circular in shape and have a diameter 65 equal to the width 45 and the pair of opposing long sides 35 would have a minor length 60 which would equal the length 50 minus the width 45.

In yet another preferred embodiment, the central opening 30 has the shapes and dimensions as follows:

| Shape of Opening | Dimensions |
|---|---|
| Round or similar shape | 1 inch in diameter 65 |
| Oval or similar shape | 1 inch minor axis 70 × 1½ inch major axis 75 |

The present invention can be made of any material that provides substantial rigidity, such as acrylic, paper, metal, wood, or porcelain.

Figure 13:
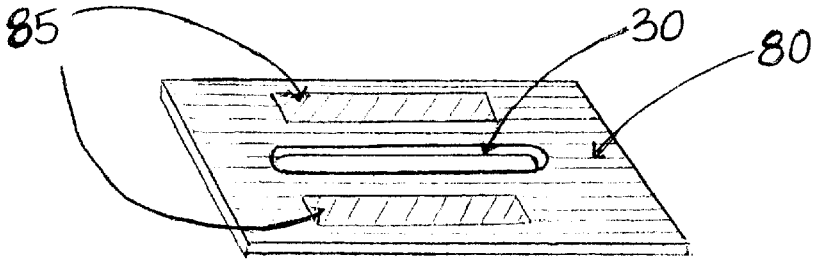
FIG. 13 illustrates one embodiment of the present invention which is disposable.

Further, the present invention can be made disposable by using a relatively inexpensive and lightweight material, such as plastic, whereby the tissue box supplemental adapter 20 is engaged with the top surface 15 of a conventional tissue box 10 using one or more pieces of double-sided adhesive tape 85 placed on a bottom surface 80 of the adapter, as in FIG. 13.

Figure 1:
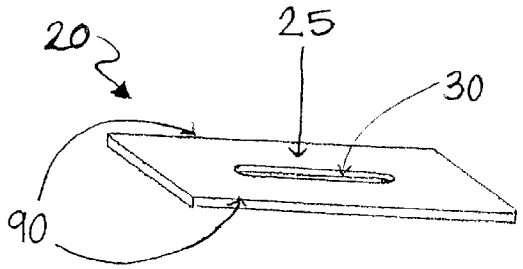
FIG. 1 illustrates a front elevational view of one embodiment of the present invention having a flat main body configuration.
Figure 2:
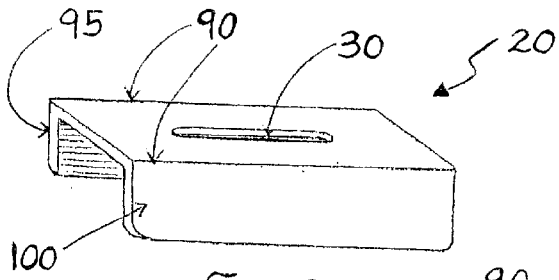
FIG. 2 illustrates a front elevational view of one embodiment of the present invention having a sliding cover configuration.

In an alternative embodiment, the tissue box supplemental adapter 20 has sides 90, and a first side panel 95 and second side panel 100 extend perpendicularly from the sides 90 toward base 105 of the a tissue box as in FIG. 11, to form an enclosed shape on three sides, as in FIG. 2.

Figure 3:
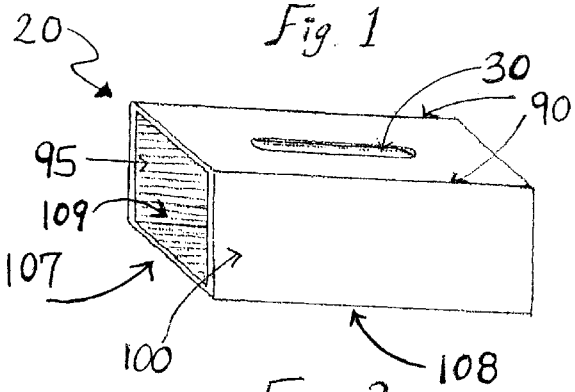
FIG. 3 illustrates a front elevational view of one embodiment of the present invention having an envelope configuration.

In another alternative embodiment, the tissue box supplemental adapter 20 further comprises bottom face 107 having first side 108 and second side 109, each connected to first side panel 95 and second side panel 100, respectively, to form an enclosed shape on four sides as in FIG. 3.

Figure 5:
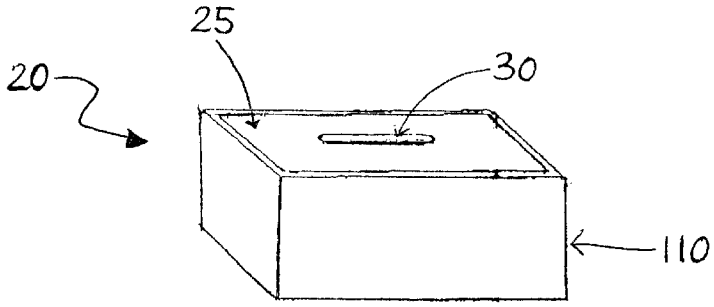
FIG. 5 illustrates a front elevational view of one embodiment of the present invention having a container with a flat main body.

In yet another alternative embodiment, the tissue box supplemental adapter 20 further comprises container 110, such that flat main body 25 may engage container 110 and rest upon a tissue box enclosed therein, as in FIG. 5.

Figure 4:
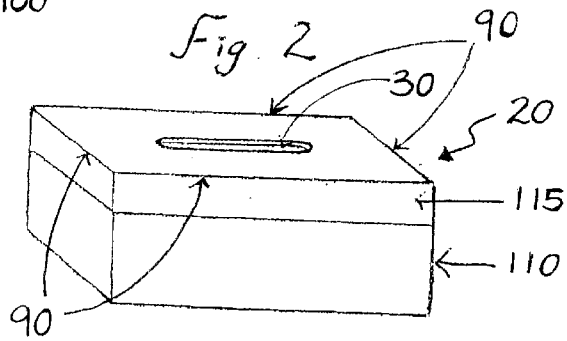
FIG. 4 illustrates a front elevational view of one embodiment of the present invention having a box configuration with a lid and a container.

In still another alternative embodiment, flat main body 25 has four sides 90 extending perpendicularly to form lid 115, which is able to engage container 110 to completely enclose a tissue box placed within the tissue box supplemental adapter 20, as in FIG. 4.

Figure 12:
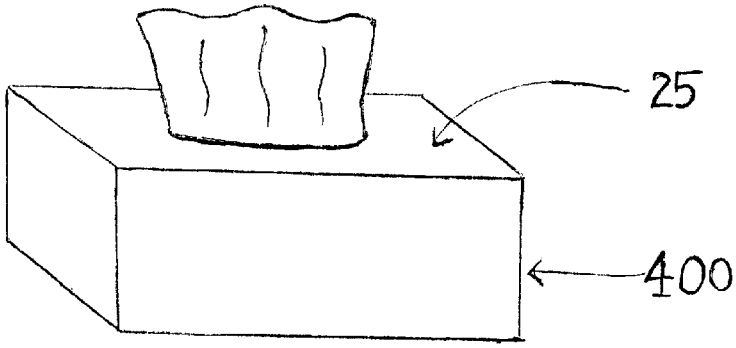
FIG. 12 illustrates one embodiment of the present invention having a tissue box configuration.

In another alternative embodiment, the invention may be a tissue box 400 itself as in FIG. 12, made so that the opening is shaped as a narrow slit, or any other narrow or small opening in any form or shape that serves the purpose of holding tissues in place, cut in the center of the flat main body 25 of the tissue box 400. Such opening may have the similar shape and dimensions as set forth above for the case of an adapter. This tissue box 400 is different from a conventional tissue box 10 as in FIG. 11, in that flat main body 25 does not have a plastic film 120 as in top surface 15 of a conventional tissue box 10.

What is claimed is:

1. A tissue box supplemental adapter for engaging a top surface of a tissue box to facilitate removal of a stack of inter layered tissues, one sheet at a time, comprising:

a. a substantially rigid flat main body having a shape substantially similar to a shape of the top surface of the tissue box, and b. a substantially rectangular central opening being located in the flat main body, the opening having a pair of opposing long sides and a pair of opposing short sides, and having a dimension of:

1) a width between ¼ and ¾ inch, inclusive, and 2) a length between 2 and 5 inches, inclusive;

wherein the pair of opposing long sides exert an inwardly length-wise pressure to the tissue which extrudes from within the tissue box through the opening, and wherein the pair of opposing short sides exerts an inwardly width-wise pressure to the tissue, which extrudes from within the tissue box through the opening, such that a frictional force between the tissue and the opening, which is sufficiently great to cause the tissue to remain withdrawn from the tissue box as the tissue is being pulled out from the tissue box, is created, and the tissues may be extracted from the tissue box, one by one, without causing breakage of the tissues;

wherein the adapter is disposable and further comprises at least one piece of double-sided adhesive tape located on a bottom surface of the flat main body, such that the adapter, being engaged with a top surface of the tissue box, forms a secure adhesion with the tissue box.

2. The adapter of claim 1, wherein the flat main body has at least two sides, and the adapter further comprises a first and a second side panel having a predetermined height, wherein the first side panel extends perpendicularly from one side of the flat main body towards a base of the tissue box, and wherein the second side panel extends from the other side of the flat main body towards the base of the tissue box on an opposing side from the first side panel, such that the adapter forms an enclosed shape on three sides which may be slid over the tissue box.

3. The adapter of claim 1, wherein the flat main body has at least two sides, and the adapter further comprises a first and a second side panel having a predetermined height, wherein the first side panel extends perpendicularly from one side of the flat main body towards a base of the tissue box, and wherein the second side panel extends from the other side of the flat main body towards the base of the tissue box on an opposing side from the first side panel, such that the adapter forms an enclosed shape on three sides which may be slid over the tissue box, and further comprising a bottom face having a first and a second side, the fist side being connected to the first side panel and the second side being connected to the second side panel to form an enclosed shape on four sides, such that the tissue box may be slid into the adapter.

4. The adapter of claim 1, wherein the flat main body has at least two sides, and the adapter further comprises a first and a second side panel having a predetermined height, wherein the first side panel extends perpendicularly from one side of the flat main body towards a base of the tissue box, and wherein the second side panel extends from the other side of the flat main body towards the base of the tissue box on an opposing side from the first side panel, such that the adapter forms an enclosed shape on three sides which may be slid over the tissue box, and further comprising a bottom face having a first and a second side, the fist side being connected to the first side panel and the second side being connected to the second side panel to form an enclosed shape on four sides, such that the tissue box may be slid into the adapter.

5. The adapter of claim 4, wherein the sides are non-linear.

6. The adapter of claim 1, further comprising a container to enclose the tissue box, such that the flat main body may engage the container and rest upon the enclosed tissue box.

7. The adapter of claim 1, wherein the flat main body has four sides, the four sides extending perpendicularly to form a lid, the lid being able to engage the container to completely enclose the tissue box placed within the adapter.

8. The adapter of claim 1, wherein the substantially rigid flat main body has a plurality of sides, wherein the sides extend perpendicularly to form a lid, the lid being able to engage the container to completely enclose the tissue box placed within the adapter.

9. The adapter of claim 8, wherein the sides are non-linear.

* * * * *